US009230528B2

(12) United States Patent
Kellett et al.

(10) Patent No.: US 9,230,528 B2
(45) **Date of Patent: *Jan. 5, 2016**

(54) SONG LENGTH ADJUSTMENT

(71) Applicant: UJAM INC., Dover, DE (US)

(72) Inventors: Paul Kellett, Bremen (DE); Peter Gorges, Bremen (DE)

(73) Assignee: UJAM INC., Dover, DE (US)

( * ) Notice: Subject to any disclaimer, the term of this patent is extended or adjusted under 35 U.S.C. 154(b) by 183 days.

This patent is subject to a terminal disclaimer.

(21) Appl. No.: 13/873,170

(22) Filed: Apr. 29, 2013

(65) Prior Publication Data

US 2014/0076124 A1 Mar. 20, 2014

Related U.S. Application Data

(60) Provisional application No. 61/702,897, filed on Sep. 19, 2012.

(51) Int. Cl.

| | |
|---|---|
| ***G10H 7/00*** | (2006.01) |
| ***G10H 1/00*** | (2006.01) |
| ***G10H 1/08*** | (2006.01) |
| ***G10H 1/36*** | (2006.01) |

(52) U.S. Cl.

CPC . *G10H 7/00* (2013.01); *G10H 1/00* (2013.01); *G10H 1/0025* (2013.01); *G10H 1/0041* (2013.01); *G10H 1/08* (2013.01); *G10H 1/36* (2013.01); *G10H 2210/061* (2013.01); *G10H 2210/125* (2013.01)

(58) Field of Classification Search

CPC ..... G10H 7/00; G10H 1/0025; G10H 1/00; G10H 1/08; G06F 17/00

USPC ..... 84/634, 609, 610, 625; 700/94

See application file for complete search history.

(56) References Cited

U.S. PATENT DOCUMENTS

| | | | | |
|---|---|---|---|---|
| 5,693,902 | A * | 12/1997 | Hufford et al. | 84/650 |
| 5,877,445 | A * | 3/1999 | Hufford et al. | 84/602 |
| 7,491,878 | B2 * | 2/2009 | Orr | 84/609 |
| 7,626,112 | B2 * | 12/2009 | Miyajima | 84/609 |
| 7,863,511 | B2 * | 1/2011 | McNally | 84/610 |
| 7,956,276 | B2 * | 6/2011 | Sako et al. | 84/625 |
| 8,026,436 | B2 * | 9/2011 | Hufford | 84/609 |
| 8,115,090 | B2 * | 2/2012 | Miyajima et al. | 84/625 |

(Continued)

FOREIGN PATENT DOCUMENTS

| | | |
|---|---|---|
| EP | 1793381 | 6/2007 |
| KR | 1020060113093 | 11/2006 |

OTHER PUBLICATIONS

PCT Search Report and Written Opinion dated Jan. 10, 2014 in PCT/US2013/060671, 14 pages.

(Continued)

*Primary Examiner* — David Warren
*Assistant Examiner* — Christina Schreiber
(74) *Attorney, Agent, or Firm* — Haynes Beffel & Wolfeld LLP

(57) ABSTRACT

A system for automatic rearrangement of a musical composition includes a process of assigning metadata to an existing piece of music to divide it into sections and identify sections of the same type, and logic to remove and rearrange sections to produced a customized playback with a desired duration and additional options for including or removing specific sections or instruments under the control of a user.

20 Claims, 7 Drawing Sheets

(56) References Cited

U.S. PATENT DOCUMENTS

| | | | | |
|---|---|---|---|---|
| 8,492,637 | B2 * | 7/2013 | Miyajima | 84/613 |
| 8,618,404 | B2 * | 12/2013 | O'Dwyer | 84/645 |
| 8,710,343 | B2 * | 4/2014 | Kellett et al. | 84/610 |
| 9,070,351 | B2 * | 6/2015 | Kellett et al. | 1/1 |
| 2004/0159221 | A1 * | 8/2004 | Camiel | 84/660 |
| 2004/0196989 | A1 * | 10/2004 | Friedman et al. | 381/119 |
| 2006/0180007 | A1 * | 8/2006 | McClinsey | 84/645 |
| 2007/0261537 | A1 * | 11/2007 | Eronen et al. | 84/611 |
| 2008/0140236 | A1 * | 6/2008 | Nonaka et al. | 700/94 |
| 2009/0133568 | A1 * | 5/2009 | Miyajima et al. | 84/625 |
| 2010/0057232 | A1 * | 3/2010 | Glatt et al. | 700/94 |
| 2010/0322042 | A1 * | 12/2010 | Serletic et al. | 369/1 |
| 2011/0131493 | A1 * | 6/2011 | Dahl | 715/716 |
| 2011/0203442 | A1 * | 8/2011 | Raveendran | 84/483.1 |
| 2014/0076124 | A1 * | 3/2014 | Kellett et al. | 84/609 |
| 2014/0076125 | A1 * | 3/2014 | Kellett et al. | 84/609 |

OTHER PUBLICATIONS

Office Action Dated Sep. 4, 2014 in related U.S. Appl. No. 13/873,187, 15 pages.

* cited by examiner

| Key | Value |
|---|---|
| length | seconds |
| tempo | beats per minute |
| meter | beats per bar |
| section_type | Intro, Ending, A, B, C ... |
| focus | boolean |

3a. Metadata for each section

| Key | Value |
|---|---|
| ID | unique identifier for associated playback data |
| name | track name for display on user interface |
| track_type | vocal/lead, vocal/lead phrases, drum, percussion, bass, backing, FX, exclusive |
| mute | boolean |

3b. Metadata for each track

| Key | Value |
|---|---|
| pickup | offset in beats relative to start of section |
| mute | boolean |

3c. Metadata for each section of each track

FIG. 3

SONG LENGTH ADJUSTMENT

RELATED APPLICATIONS

This application claims the benefit of U.S. Provisional Patent Application No. 61/702,897 filed on 19 Sep. 2012, which application is incorporated by reference as if fully set forth herein.

REFERENCE TO COMPUTER PROGRAM LISTING APPENDIX

A computer program listing appendix accompanies this application and is incorporated by reference.

BACKGROUND

1. Field of the Invention

The present invention relates to technology for computer-based rearrangement of a musical composition.

2. Description of Related Art

It is often desirable to add music to a piece of video or film to enhance the mood or impact experienced by the viewer. In high budget productions music is composed specifically for the film, but in some cases the producer or editor will want to use an existing piece of music. Libraries of "Production Music" are available for this purpose with a broad range of music genres and lower licensing costs than commercially released music.

An existing piece of music is unlikely to have the same length as the film scenes it is set to, so either the film is edited to fit the music or more commonly the music is edited to fit the film. Making manual edits in the middle of a piece of music often gives unsatisfactory results, so usually the editor will select a section of the music with the wanted length and apply a cut or fade at the ends of the section.

The editor may wish to select a quiet or unobtrusive part of the music, or a loud dynamic part depending on the wanted effect. Some professional music libraries offer music in "stem" format where instead of a single stereo recording there are separate recordings of (for example) vocals, drums, bass and other accompaniment and the editor can combine or omit each stem as desired. Or there may be multiple versions to choose from, such as "full mix", "mix with no vocals" or "mix with no drums". However it requires additional work by the editor to utilize the music in stem form and additional resources to handle the increased amount of data and number of simultaneous audio tracks.

Technologies have been developed for composing music with a given length, or compiling pre-existing sections of music to a given length but these cannot be applied to large existing libraries of music without musical knowledge and a great deal of manual preparation and editing.

SUMMARY

Technologies are described here for taking an existing piece of music in any form but typically one or more audio tracks to be played simultaneously and pre-prepared metadata describing the piece of music, where the description includes how to split the music into a number of musically meaningful sections, marking which sections have similar content, and measuring the length of musical bars; and automatically editing the piece of music to fit a wanted length, either fully automatically or with simple options controllable by the user.

BRIEF DESCRIPTION OF THE DRAWINGS

FIG. 3 consists of tables showing the organization of metadata for a song used in a music rearrangement automation process described herein.

DETAILED DESCRIPTION

The basis of the technology described here is splitting existing musical compositions into sections. It is assumed that a song consists of a number of middle sections which may be preceded by one or more Intro sections, and may be followed by one or more Ending sections. Each middle section is labeled with a letter A, B, C, etc. If a middle section has the same type of content as another (for example they are both verses, or both choruses) they are labeled with the same letter, otherwise the next available letter is used, working from the start of the song to the end so that the first middle section is always labeled A, the first B section is always later in the song than the first A section, the first C section is always later in the song than the first B section, and so on for as many different types of section exist in the song.

Figure 1:
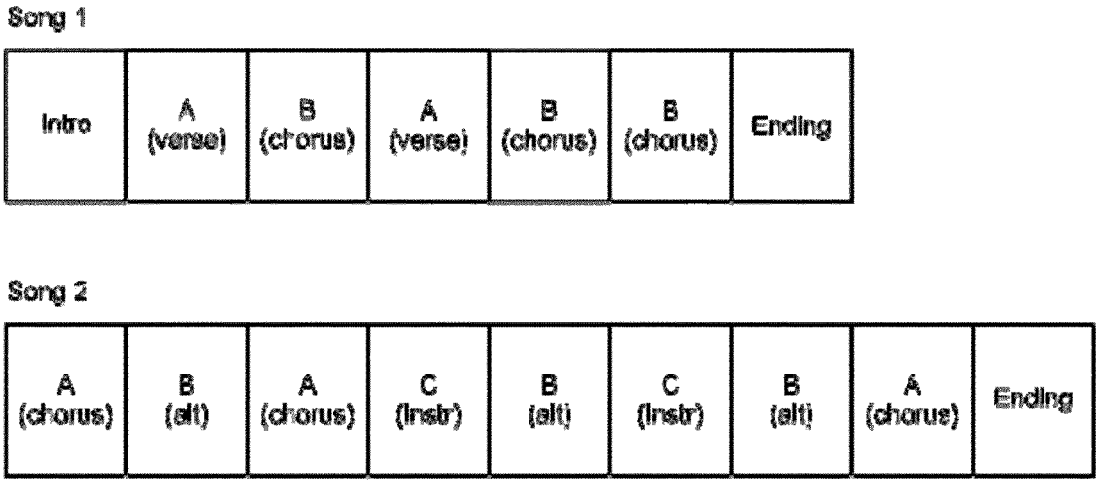
FIG. 1 is a block diagram showing how two different songs can be divided into sections and a scheme for labeling the section types applied.

FIG. 1 shows two different songs that have been split into sections using this scheme. The first song is a simple pop song with an intro; verses that have been labeled A; choruses that have been labeled B; and an ending. The second song has a less traditional form: It has no intro or verses but starts immediately with a chorus, followed by an alternative version of the chorus, and later in the song there are two instrumental breaks. These two examples show the benefit of the labeling scheme used: It is not required to give a name to the musical content each section contains (i.e. verse, chorus) as often this is ambiguous. It is only required to decide which sections have the same type of musical content and label them with the same letter.

In one possible implementation, songs are split into sections using a semi-automated process. A software utility displays the audio waveform of the song and allows a key to be tapped in time with playback to indicate the tempo and bar positions, followed by additional taps during playback at points where the song should be split, which are then rounded to the nearest musical bar. In some music, particularly classical/orchestral, it may not be possible to set exact split points because of notes with overlaps or slow onsets. In this situation split points can be positioned at the ends of pauses or other quiet moments in the music rather than at the barlines of music sections, so that later editing of the audio at these points will be less conspicuous.

Figure 2:
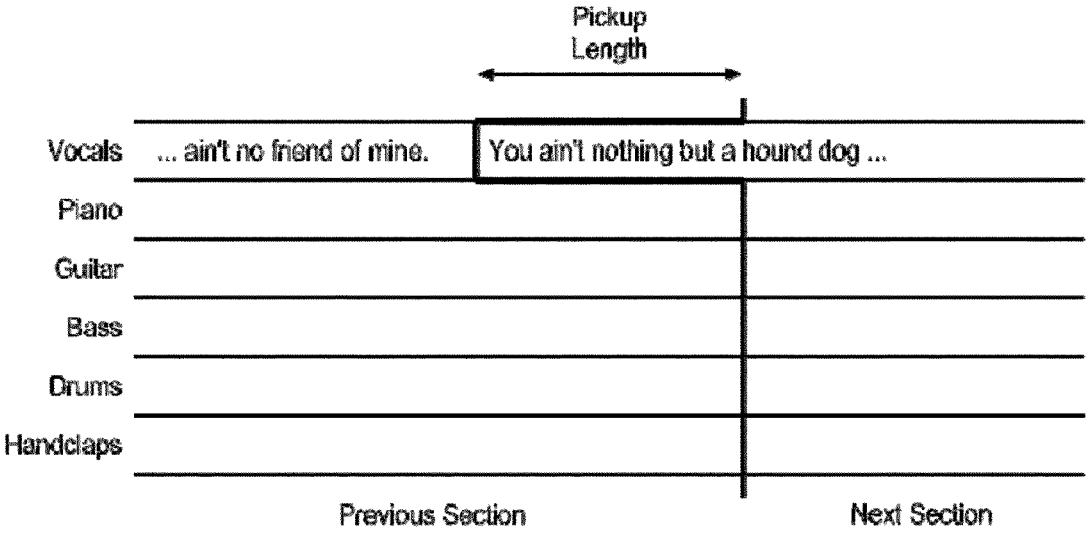
FIG. 2 illustrates how some musical parts begin before the start of the section they are associated with, using an example from a well-known song.

Some songs include one or more examples of a "pickup" or anacrusis where the vocals or lead instrument may play across the start of a section. FIG. 2 shows an example from the song "Hound Dog" where the lyrics "You ain't nothing but a" are sung before the accompanying instruments start playing the chorus section, followed by the lyrics "hound dog" in the first musical bar of the section. The lyrics only make sense when played in their entirety, so a pickup length must be defined that extends the section start earlier relative to the start of the first bar. When multi-track audio or stems are available with the vocals in a separate recording, the pickup length can be defined just for the vocal track, so whenever the section is played the vocal track must start playing earlier than the other tracks to include the pickup. When the song is only available as a single recording it is still better to start playing the section earlier by the pickup length, but all instruments will start playing early which may sound unnatural.

FIG. 3 shows the metadata compiled for each song and associated with the audio recordings for the song. Table 3*a* lists the metadata for each section of the song. This includes the length in seconds and the musical tempo and meter. In some cases the tempo will already be known and the length in seconds can be calculated from length in bars and beats. In other cases the length can be measured in the audio waveform and the tempo calculated. It is possible to store section and bar lengths in seconds, or in beats at a given tempo, as one can be calculated from the other. Also stored for each section is section_type (Intro, Ending, A, B, C, etc.) and a focus flag which is described below.

Table 3*b* lists the metadata for each audio track. This includes an ID that can be used to find the associated audio data, and a name for the track which can be displayed to the user when required. Also stored is a track_type which can be useful for displaying the tracks to the user (for example color coding depending on the type) but the value can also be used to affect the rearranged song playback: When the track_type is "vocal/lead phrases" this indicates that the contents of each section (including any pickup) only makes sense when played in its entirety, and playing only half of the section would risk cutting off a sung or melodic phrase in mid flow. When the track_type is "exclusive" only one of the tracks in the song of this type should be played at a time as they are alternate versions of the same thing.

Table 3*c* lists the metadata for each section of each track. This includes a pickup length as described above, stored as an offset in musical beats relative to the start of the section. This could interchangeably be stored as a value in seconds as the tempo is known and relates seconds to beats. A mute value is also stored for each track and each section of each track but this is not used in the automatic song rearrangement but is available as a user control for customizing the resulting playback.

Figure 4:
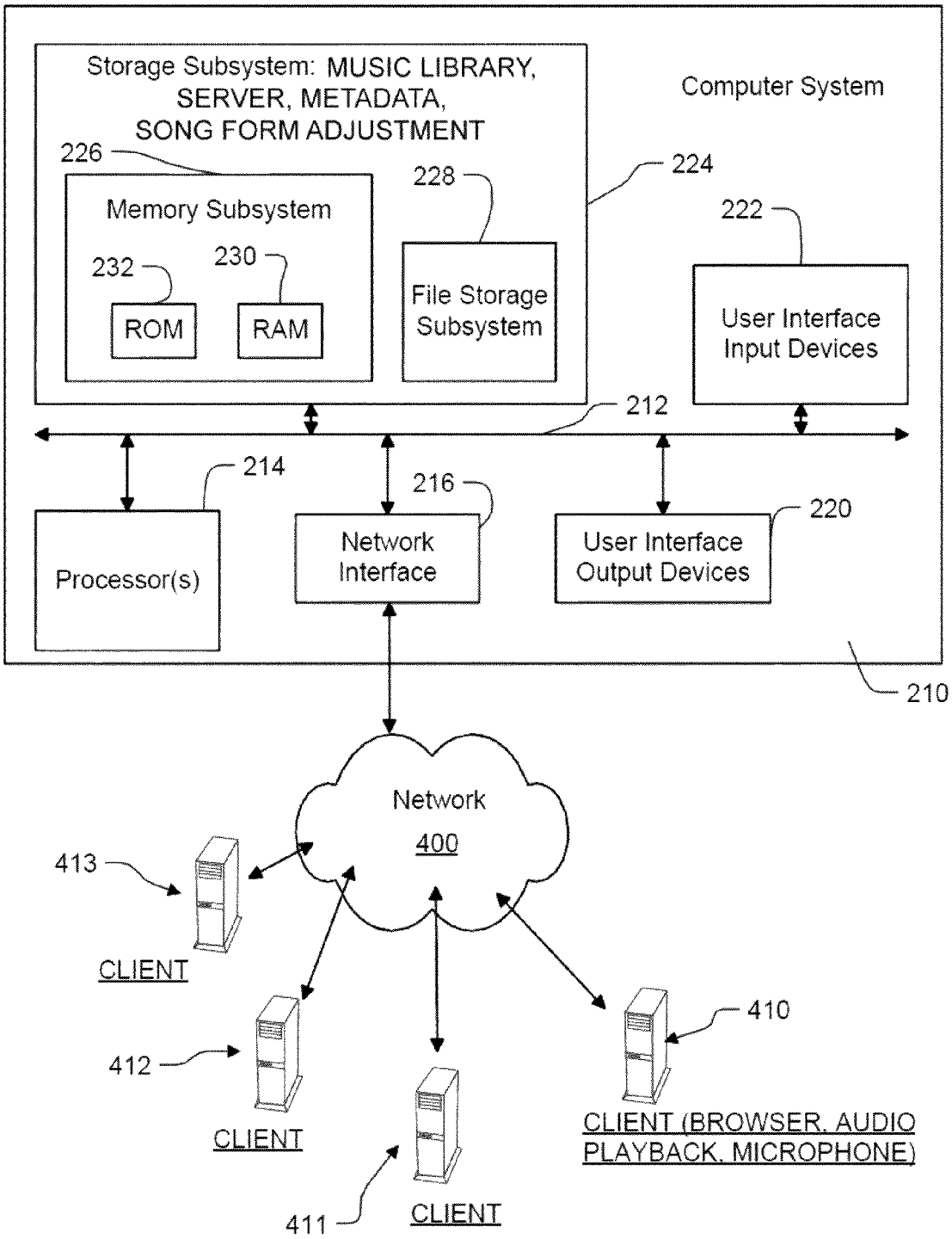
FIG. 4 is a simplified diagram of a data processing system implementing music rearrangement automation as described herein.

FIG. 4 illustrates a data processing system configured for computer assisted automation of music rearrangement such as described herein, arranged in a client/server architecture.

The system includes a computer system 210 configured as a server including resources for storing a library of audio recordings, associating metadata with those recordings, processing the metadata to create a rearranged song form, and rendering the resulting rearranged song using data from the audio recordings. In addition, the computer system 210 includes resources for interacting with a client system (e.g. 410) to carry out the process in a client/server architecture.

Computer system 210 typically includes at least one processor 214 which communicates with a number of peripheral devices via bus subsystem 212. These peripheral devices may include a storage subsystem 224, comprising for example memory devices and a file storage subsystem, user interface input devices 222, user interface output devices 220, and a network interface subsystem 216. The input and output devices allow user interaction with computer system 210. Network interface subsystem 216 provides an interface to outside networks, and is coupled via communication network 400 to corresponding interface devices in other computer systems. Communication network 400 may comprise many interconnected computer systems and communication links. These communication links may be wireline links, optical links, wireless links, or any other mechanisms for communication of information. While in one embodiment, communication network 400 is the Internet, in other embodiments, communication network 400 may be any suitable computer network.

User interface input devices 222 may include a keyboard, pointing devices such as a mouse, trackball, touchpad, or graphics tablet, a scanner, a touchscreen incorporated into the display, audio input devices such as voice recognition systems, microphones, and other types of input devices. In general, use of the term "input device" is intended to include possible types of devices and ways to input information into computer system 210 or onto communication network 400.

User interface output devices 220 may include a display subsystem, a printer, a fax machine, or non-visual displays such as audio output devices. The display subsystem may include a cathode ray tube (CRT), a flat-panel device such as a liquid crystal display (LCD), a projection device, or some other mechanism for creating a visible image. The display subsystem may also provide non-visual display such as via audio output devices. In general, use of the term "output device" is intended to include all possible types of devices and ways to output information from computer system 210 to the user or to another machine or computer system.

Storage subsystem 224 includes memory accessible by the processor or processors, and by other servers arranged to cooperate with the system 210. The storage subsystem 224 stores programming and data constructs that provide the functionality of some or all of the processes described herein. Generally, storage subsystem 212 will include server management modules, a music library as described herein, and programs and data utilized in the automated music rearrangement technologies described herein. These software modules are generally executed by processor 214 alone or in combination with other processors in the system 210 or distributed among other servers in a cloud-based system.

Memory used in the storage subsystem can include a number of memories arranged in a memory subsystem 226, including a main random access memory (RAM) 230 for storage of instructions and data during program execution and a read only memory (ROM) 232 in which fixed instructions are stored. A file storage subsystem 228 can provide persistent storage for program and data files, and may include a hard disk drive, a floppy disk drive along with associated removable media, a CD-ROM drive, an optical drive, or removable media cartridges. The modules implementing the functionality of certain embodiments may be stored by file storage subsystem in the storage subsystem 224, or in other machines accessible by the processor.

Bus subsystem 212 provides a mechanism for letting the various components and subsystems of computer system 210 communicate with each other as intended. Although bus subsystem 212 is shown schematically as a single bus, alternative embodiments of the bus subsystem may use multiple busses. Many other configurations of computer system 210 are possible having more or less components than the computer system depicted in FIG. 4.

The computer system 210 can comprise one of a plurality of servers, which are arranged for distributing processing of data among available resources. The servers include memory for storage of data and software applications, and a processor for accessing data and executing applications to invoke its functionality.

The system in FIG. 4 shows a plurality of client computer systems 410-413 arranged for communication with the computer system 210 via network 400. The client computer system 410 can be of varying types including a personal computer, a portable computer, a workstation, a computer terminal, a network computer, a television, a mainframe, a smartphone, a mobile device, or any other data processing system or computing device. Typically the client computer system 410-413 will include a browser or other application enabling interaction with the computer system 210, audio playback devices which produce sound from a rearranged piece of music.

In a client/server architecture, the computer system 210 provides an interface to a client via the network 400. The client executes a browser, and renders the interface on the local machine. For example, a client can render a graphical user interface in response to a webpage, programs linked to a webpage, and other known technologies, delivered by the computer system 210 to the client 410. The graphical user interface provides a tool by which a user is able to receive information, and provide input using a variety of input devices. The input can be delivered to the computer system 210 in the form of commands, parameters for use in performing the automated rearrangement processes described herein, and the like, via messages or sequences of messages transmitted over the network 400.

In one embodiment, a client interface for the music rearrangement automation processes described here can be implemented using HTML 5 and run in a browser. The client communicates with an audio render server that gets selected based on the region the user logs in from. The amount of audio servers per region is designed to be scalable by making use of cloud computing techniques. The different protocols that get used for communication with the servers can include RPC, and REST via HTTP with data encoded as JSON/XML.

Although the computing resources are described with reference to FIG. 4 as being implemented in a distributed, client/server architecture, the technologies described herein can also be implemented using locally installed software on a single data processing system including one or more processors, such as a system configured as a personal computer, a mobile device, or as any other machine having sufficient data processing resources. In such system, the single data processing system can provide an interface on a local display device, and accept input using local input devices, via a bus system, like the bus subsystem 212, or other local communication technologies.

Figure 5:
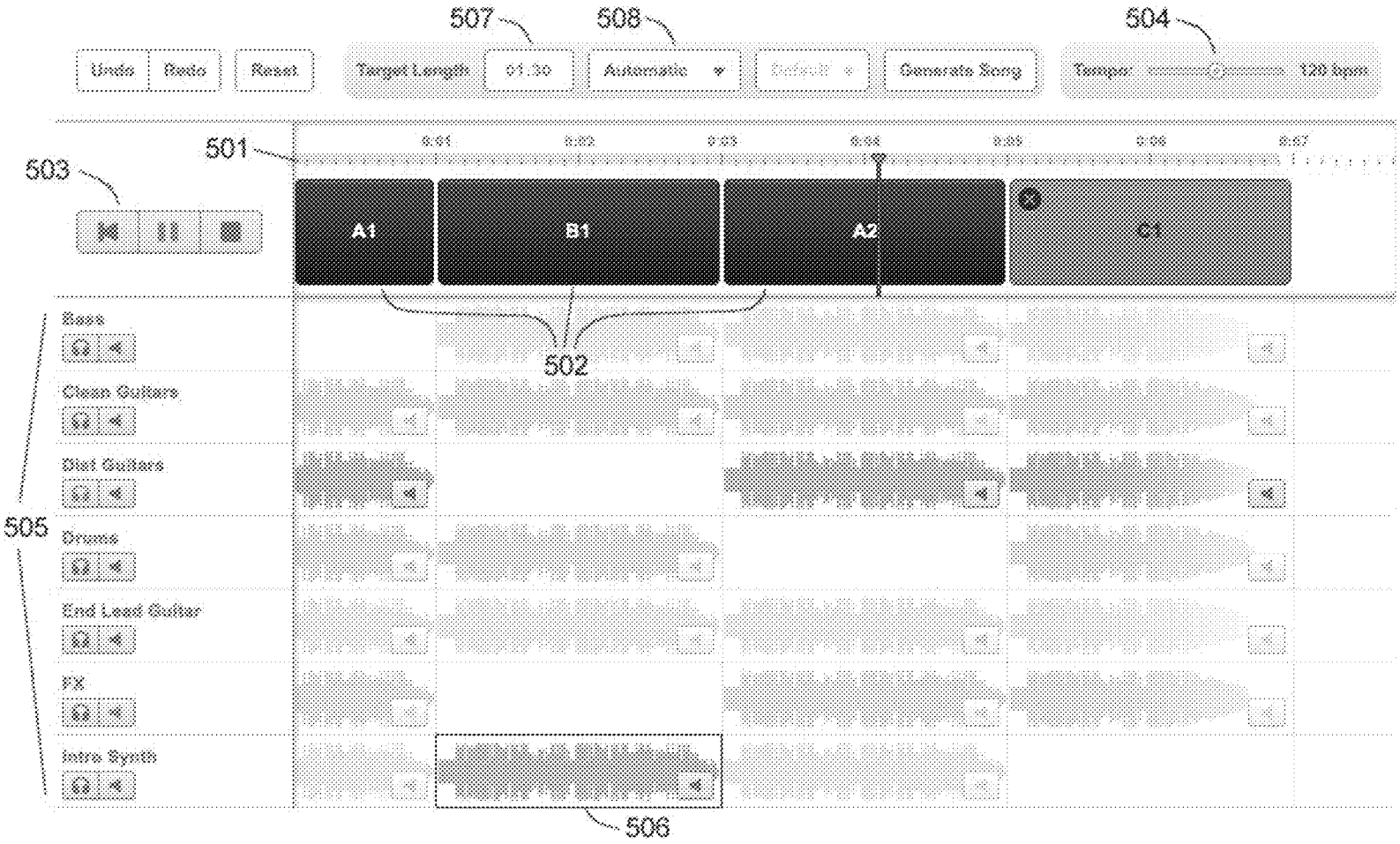
FIG. 5 illustrates a graphic user interface which can be implemented to support the music rearrangement automation process.

FIG. 5 illustrates a graphic user interface which can be implemented to support the music rearrangement process, and presented on a client system prompting music rearrangement. This can be presented on a local interface, or in a client/server architecture as mentioned above. An interface as described herein provides a means for prompting a client to begin the session and for selecting a piece of music to be rearranged. Sections of the chosen piece of music are represented as blocks 502 along a timeline 501. Playback controls 503 allow the user to hear the current arrangement and the current playback position is indicated by a marker moving along the timeline. An alternative arrangement can be generated by inputting a desired length 507 and optionally setting other options 508 for the automatic rearrangement process including setting a focus section which should be included in the resulting arrangement, and the option to not include sections before or after the focus section.

Multiple audio tracks 505 can be shown parallel to the timeline with controls to mute whole tracks or individual sections of a track 506. The mute function when engaged stops the muted item being heard in the playback.

An alternative implementation allows a video clip and a piece of music to be selected, then the music is automatically rearranged so it has the same duration as the video clip with no other user interaction required.

Figure 6:
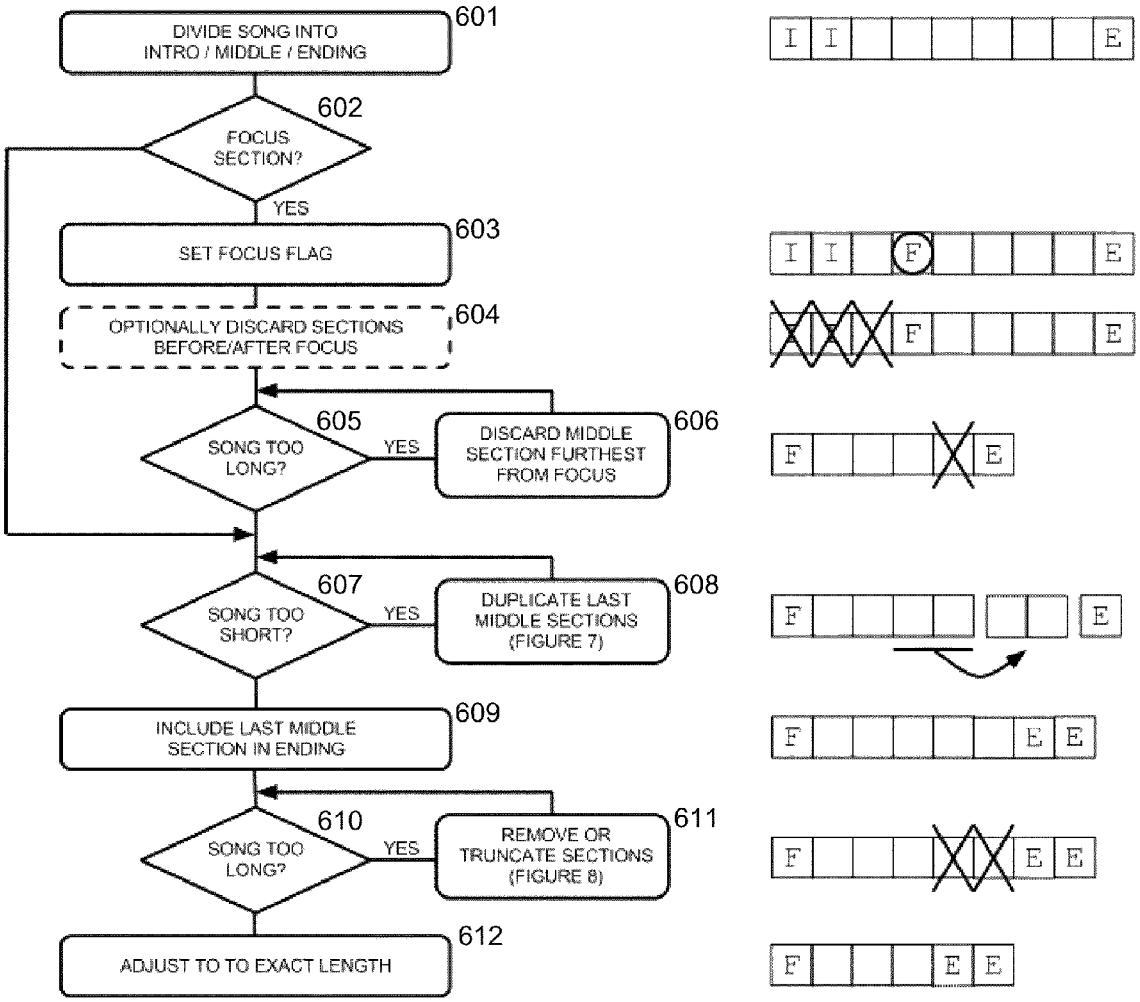
FIG. 6 is a flow diagram for a music rearrangement automation process with examples of the resulting changes to song sections.

FIG. 6 is a flowchart showing steps applied in a musical rearrangement process. The order of the steps shown in FIG. 6 is merely representative, and can be rearranged as suits a particular session or particular implementation of the technology. Pre-requisites for the process are the metadata for the sections of a piece of music as shown in FIG. 3, and the wanted length of the resulting rearrangement.

The first step 601 is to simply divide the sections into three groups: Sections labeled as Intro; middle sections labeled A, B, C, etc; and sections labeled as Ending. In the example song form shown in FIG. 6 there are two Intro sections (I) and one Ending section (E). This division is done because some of the subsequent operations should be applied to the middle sections only, so that Intro and Ending sections are not included in the middle of the resulting rearrangement where they may sound unnatural. At this point the total length of the sections in the song can be measured, and if there is silence at the start of the first section or the end of the last section this should not be included in the measurement. The measured length is updated as sections are added and removed in the following steps so it can be compared to the wanted length.

If the user has specified that one or more sections should preferably be included in the rearrangement 602 then the "focus" flag is set in the metadata for these sections. If the user has specified that sections before or after the focus section(s) should not be included in the rearrangement then these sections are removed 604 including any Intro or Ending sections. The last step regarding focus sections is to discard middle sections furthest from the focus section(s) if the song is longer than the wanted length. This is done to move sections closer to the middle of the song if they are not already at the start or end of the song due to discarding sections in the previous step. While the song is longer than the wanted length the furthest middle section from the focus section(s) is discarded until removing the section would make the song shorter than the wanted length.

Figure 7:
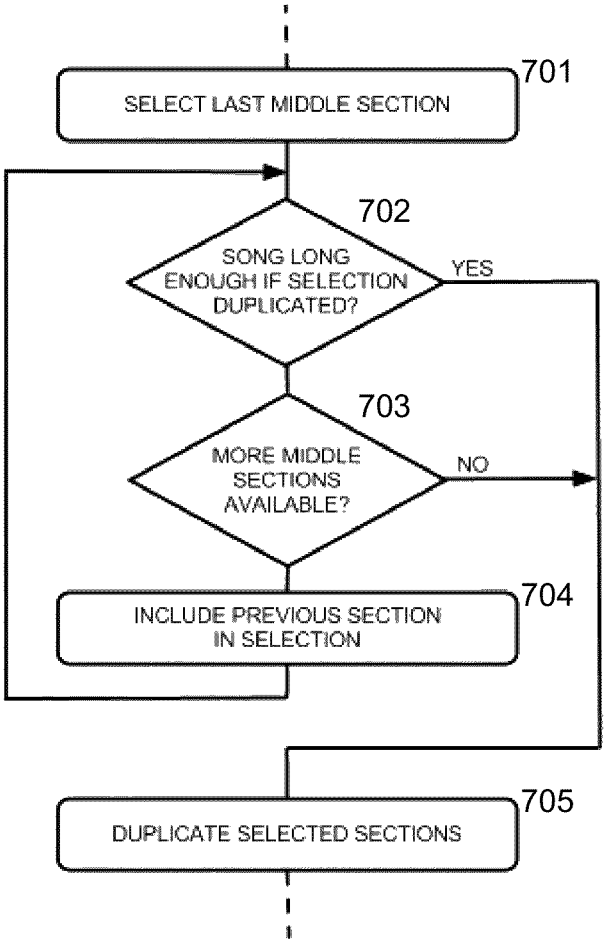
FIG. 7 is a flow diagram showing the section duplication process of FIG. 6 in more detail.

Whether focus sections exist or not, Step 607 now checks if the song is shorter than the wanted length, and if so, duplicates as many sections as needed until the song is at least the wanted length. FIG. 7 shows this process in more detail: Initially the last middle section is selected for duplication 701, and while the current song length plus the length of the selected section(s) is less than the wanted song length, the selection is increased to include the preceding middle section 704. When the song length plus the length of the selected sections exceeds the wanted length, or there are no more middle sections to add to the selection, the selected sections are duplicated and inserted after the last middle section 705. If the song is still shorter than the wanted length the process in FIG. 7 is repeated. This method of duplicating sections to extend the length of the song has a number of benefits:

The original order of sections in the song is maintained except at the start of the duplicated section, and even that transition from the section_type of the last middle section to the section_type of the first duplicated section is likely to already occur somewhere else in the song. This is an advantage because the original order of sections in the song can be assumed to sound good.

If the song is only slightly shorter than wanted the last one or two middle sections will be repeated, which is similar to what a songwriter or arranger would do—for example repeating the last chorus of a song.

Music often features a gradual rise in intensity from start to end interspersed with small drops in intensity such as the transition from the end of a chorus to the start of the next verse, and this is maintained, giving musically appropriate results without needing to know the musical content of each section.

The next step in FIG. 6 (609) is to re-classify the last middle section as an ending section so that it is treated in the following step as part of the ending. This is done so that the last middle section will not be removed creating a transition from some other section to the ending which may sound unnatural.

Figure 8:
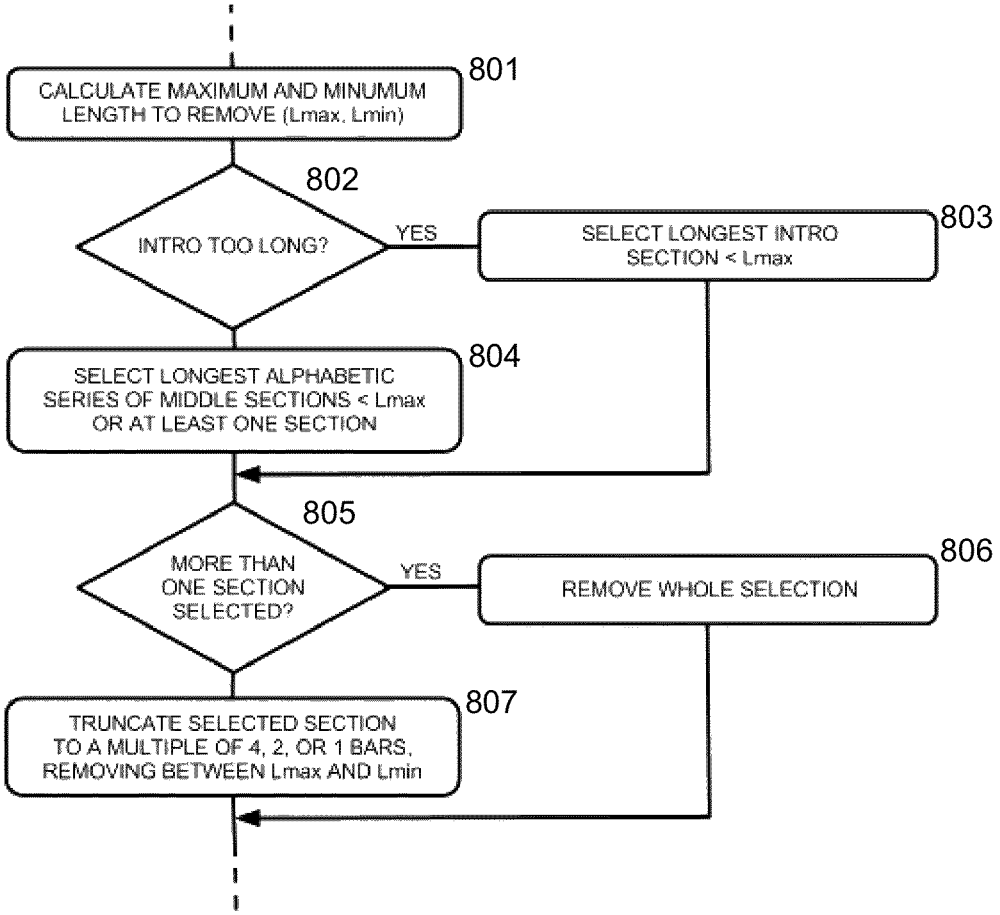
FIG. 8 is a flow diagram showing the section removal process of FIG. 6 in more detail.

Step 610 now checks if the song is longer than the wanted length, and if so, removes or truncates as many sections as needed until no more sections can be removed without making the song shorter than the wanted length. This is done with the aim of positioning the end of the last section close to the wanted length. FIG. 8 shows this process in more detail: Firstly a maximum and minimum length to be removed is calculated. The maximum is the wanted length subtracted from the current length, and the minimum is the maximum minus a small leeway as it is impractical to remove exactly the maximum in most cases. In one implementation the leeway is half the length of the last section, with the result that if the minimum length is removed then the wanted length will occur half way through the last section of the song, and the last half of the last section can likely be discarded without sounding unnatural if its musical content consists of a fade-out, long held notes fading away, or reverberation.

Step 802 now decides if an Intro section or middle section (s) should be removed from the song to reduce its length. In one implementation an Intro section should be removed if the total length of all Intro sections exceeds 25% of the wanted length of the song or exceeds the minimum length to be removed. In this case the longest Intro section that is not longer than the maximum length to be removed is selected (803). In the case that an Intro section should not be removed (or no Intro sections exist in the arrangement at this point) then a range of consecutive middle sections are selected (804) where all possible ranges are examined and the one with the longest length that is less than the maximum length to be removed is selected that also satisfies the constraint that the section_type of each section in the series are sorted alphabetically (i.e. any section can follow an A section, any section except A can follow a B section, any section except A and B can follow a C section, and so on). As section types labeled with a later letter of the alphabet first occurred later in the original song than earlier letters and sections later in the song generally have higher intensity, this constraint tends to result in series of sections with increasing intensity being selected (such as a verse followed by a chorus, as opposed to a chorus followed by a verse). When the selected sections are removed from the song the remaining sections are more likely to maintain a pattern of slowly rising intensity interspersed with small drops in intensity. In the case that all possible ranges of sections, including ranges of just one section, are longer than the maximum length to be removed then the shortest section is selected.

Step 805 checks if more than one section has been selected and removes the whole selection from the song (806) otherwise one section has been selected and may be longer than the maximum length to be removed. If it is not longer the whole section is removed, otherwise the selected section kept in the song but truncated. At this point the metadata for musical meter and tempo is used to calculate the length of a musical bar so the section can be truncated such that the removed length is less than the maximum length to be removed and the retained length is a multiple of four bars. Four bars is chosen because the most common chord sequences in music are two or four bars long, and other common lengths such as eight and twelve bars are also likely to sound more natural when truncated to a multiple of four bars than any other length. If however a length between the minimum and maximum calculated above can be removed by truncating the section to a multiple of two or one bars is possible but not possible by truncating to a multiple of four bars, then the section is truncated to a length that is a multiple of two or one bars if it is considered more important to reach close to the wanted length than to maintain chord sequences.

In the case that a section is truncated the track_type metadata is examined for each track, and if the track_type is set to "vocal/lead phrases" the mute flag is set in the metadata for that section of that track. This ensures that vocal or instrumental phrases will not be cut off in mid flow when the section ends earlier than in the original arrangement.

The last step of FIG. 6 (612) is to adjust the song to the exact wanted length, as it is now as close as could be achieved by adding or removing sections and truncating a section to a multiple of bar lengths. In one possible implementation this can be done by adjusting the song's musical tempo by the percentage difference between the wanted and current length. However this may lead to a reduction of audio quality if timestretching must be applied to the audio waveform to realize the tempo change on playback. In an alternative implementation a short fade-out is applied such that the end of the fade is at exactly the wanted song length. A fade length of two seconds is adequate, and the fade is likely to start towards the end of the last section of the song where it will not sound unnatural.

The rearrangement described so far has been applied to the metadata associated with a piece of music, starting with the metadata of the original song and copying or removing items of metadata and modifying some values in the metadata such as mutes to form a new arrangement. After the rearrangement process the resulting song can be played or rendered to an audio file for later playback or use in other software. Playback is rendered using the audio data associated with the tracks, and scheduling which parts of the audio data should be played at which times on the playback timeline based on the rearranged metadata. Where audio data must start or stop playback other than at the start or end of the recording it is beneficial to apply a short fade (a few milliseconds in length) so the audio waveform does not start or stop abruptly leading to unwanted clicks. These fades can be applied while the playback audio is being rendered, or can be applied in advance as the location of sections in the recording is already specified in the metadata.

While the present invention is disclosed by reference to the preferred embodiments and examples detailed above, it is understood that these examples are intended in an illustrative rather than in a limiting sense. Computer-assisted processing is implicated in the described embodiments. Accordingly, the present invention may be embodied in methods for perform processes described herein, systems including logic and resources to perform processes described herein, systems that take advantage of computer-assisted methods for performing processes described herein, media impressed with logic to perform processes described herein, data streams impressed with logic to perform processes described herein, or computer-accessible services that carry out computer-assisted methods for perform processes described herein. It is contemplated that modifications and combinations will readily occur to those skilled in the art, which modifications and combinations will be within the spirit of the invention and the scope of the following claims.

What is claimed is:

1. A method for increasing the duration of a pre-existing recording of a musical composition comprising:

accessing a recording of a musical composition, the recording having a duration with an initial length, data identifying a wanted length for a rearrangement of the musical composition, partition metadata partitioning the recording of the composition into a sequence of sections, and classification metadata classifying sections in the sequence according to musical content using a data processor; and producing a rearrangement of the composition using logic executed by the data processor, the rearrangement having an increased duration, which adds a repeating series of consecutive sections in the sequence according to the classification metadata, such that the rearrangement has the increased duration according to the wanted length.

2. The method of claim 1, wherein sections classified as intro or ending are excluded from repetition.

3. The method of claim 1, wherein the series of sections to be repeated always includes the last section in the sequence that is not classified as an intro or ending.

4. A method for reducing the duration of a pre-existing recording of a musical composition comprising:

accessing a recording of a musical composition, the recording having a duration with an initial length, data identifying a wanted length for a rearrangement of the musical composition, partition metadata partitioning the recording of the composition into a sequence of sections, and classification metadata classifying sections in the sequence according to musical content using a data processor; and producing a rearrangement of the composition using logic executed by the data processor, the rearrangement having a reduced duration, which removes one or more consecutive sections in the sequence according to the classification metadata, such that the rearrangement has the reduced duration according to the wanted length.

5. The method of claim 4, wherein sections classified as intro or ending are excluded from removal.

6. The method of claim 4, wherein sections classified as intro or ending are excluded from removal if their duration does not exceed a pre-defined proportion of the wanted duration of the arrangement.

7. The method of claim 4, wherein the new arrangement is brought closer to the wanted duration by truncating one of the remaining sections such that its duration is a multiple of four musical bars, or a multiple of two bars if the nearest multiple of four does not bring the arrangement within a margin of the wanted length.

8. An apparatus comprising:

a data processing system including a processor and memory, and encoded media data and an electronic document stored in the memory, the electronic document including a script or a link to a script that includes instructions executable by a computer, and instructions including logic to increase the duration of a pre-existing musical composition comprising:

accessing a recording of a musical composition, the recording having a duration with an initial length, data identifying a wanted length for a rearrangement of the musical composition, partition metadata partitioning the recording of the composition into a sequence of sections, and classification metadata classifying sections in the sequence according to musical content using a data processor; and producing a rearrangement of the composition using logic executed by the data processor, the rearrangement having an increased duration, which adds a repeating series of consecutive sections in the sequence according to the classification metadata, such that the rearrangement has the increased duration according to the wanted length.

9. The apparatus of claim 8, wherein sections classified as intro or ending are excluded from repetition.

10. The apparatus of claim 8, wherein the series of sections to be repeated always includes the last section in the sequence that is not classified as an intro or ending.

11. An apparatus comprising:

a data processing system including a processor and memory, and encoded media data and an electronic document stored in the memory, the electronic document including a script or a link to a script that includes instructions executable by a computer, and instructions including logic to reduce the duration of a pre-existing musical composition comprising:

accessing a recording of a musical composition, the recording having a duration with an initial length, data identifying a wanted length for a rearrangement of the musical composition, partition metadata partitioning the recording of the composition into a sequence of sections, and classification metadata classifying sections in the sequence according to musical content using a data processor; and producing a rearrangement of the composition using logic executed by the data processor, the rearrangement having a reduced duration, which removes one or more consecutive sections in the sequence according to the classification metadata, such that the rearrangement has the reduced duration according to the wanted length.

12. The apparatus of claim 11, wherein sections classified as intro or ending are excluded from removal if their duration does not exceed a pre-defined proportion of the wanted duration of the arrangement.

13. The apparatus of claim 11, wherein the new arrangement is brought closer to the wanted duration by truncating one of the remaining sections such that its duration is a multiple of four musical bars, or a multiple of two bars if the nearest multiple of four does not bring the arrangement within a margin of the wanted length.

14. An apparatus comprising:

a memory including a non-transitory data storage medium, a script stored in the memory that includes instructions executable by a computer, the instructions including logic to increase the duration of a pre-existing musical composition comprising:

accessing a recording of a musical composition, the recording having a duration with an initial length, data identifying a wanted length for a rearrangement of the musical composition, partition metadata partitioning the recording of the composition into a sequence of sections, and classification metadata classifying sections in the sequence according to musical content using a data processor; and producing a rearrangement of the composition using logic executed by the data processor, the rearrangement having an increased duration, which adds a repeating series of consecutive sections in the sequence according to the classification metadata, such that the rearrangement has the increased duration according to the wanted length.

15. The apparatus of claim 14, wherein sections classified as intro or ending are excluded from repetition.

16. The apparatus of claim 14, wherein the series of sections to be repeated always includes the last section in the sequence that is not classified as an intro or ending.

17. An apparatus comprising:

a memory including a non-transitory data storage medium, a script stored in the memory that includes instructions executable by a computer, the instructions including logic to reduce the duration of a pre-existing musical composition comprising:

accessing a recording of a musical composition, the recording having a duration with an initial length, data identifying a wanted length for a rearrangement of the musical composition, partition metadata partitioning the recording of the composition into a sequence of sections, and classification metadata classifying sections in the sequence according to musical content using a data processor; and producing a rearrangement of the composition using logic executed by the data processor, the rearrangement having a reduced duration, which removes one or more consecutive sections in the sequence according to the classification metadata, such that the rearrangement has the reduced duration according to the wanted length.

18. The apparatus of claim 17, wherein sections classified as intro or ending are excluded from removal.

19. The apparatus of claim 17, wherein sections classified as intro or ending are excluded from removal if their duration does not exceed a pre-defined proportion of the wanted duration of the arrangement.

20. The apparatus of claim 17, wherein the new arrangement is brought closer to the wanted duration by truncating one of the remaining sections such that its duration is a multiple of four musical bars, or a multiple of two bars if the nearest multiple of four does not bring the arrangement within a margin of the wanted length.

* * * * *